US005542636A

United States Patent [19]

Mann et al.

[11] Patent Number: 5,542,636

[45] Date of Patent: Aug. 6, 1996

[54] CLIPS FOR SUPPORTING MINIATURE CHRISTMAS LIGHTS AT ANY OF A PLURALITY OF LOCATIONS

[76] Inventors: John P. Mann; Barbara A. Mann, both of 24 Tracey St., Spring City, Pa. 19475

[21] Appl. No.: 344,017

[22] Filed: Nov. 23, 1994

[51] Int. Cl.[6] ..... A47B 96/06

[52] U.S. Cl. ..... 248/229.26; 248/231.81; 248/229.15; 362/396

[58] Field of Search ..... 362/396; 248/229, 248/231.8, 229.15, 229.26, 231.81

[56] References Cited

U.S. PATENT DOCUMENTS

| | | | |
|---|---|---|---|
| D. 324,991 | 3/1992 | Gary | D8/354 |
| D. 340,183 | 10/1993 | Rumpel | D8/395 |
| 1,895,656 | 1/1933 | Gadke | 248/231.8 |
| 2,225,584 | 12/1940 | Del Camp | 362/396 |
| 2,599,303 | 6/1952 | Ward | 362/396 |
| 3,584,795 | 6/1971 | Baird | 362/396 |
| 3,596,859 | 8/1971 | MacDonald | 248/214 |
| 3,749,346 | 7/1973 | Cherniak | 248/302 |
| 4,121,798 | 10/1978 | Schumacher et al. | 248/229 |
| 4,214,688 | 7/1980 | Griffin | 362/396 |
| 5,103,380 | 4/1992 | Linder et al. | 362/32 |

FOREIGN PATENT DOCUMENTS

| | | | |
|---|---|---|---|
| 1092074 | 12/1980 | Canada | 248/229 |
| 2817933 | 8/1979 | Germany | 248/229 |
| 2031510 | 4/1980 | United Kingdom | 248/229 A |

*Primary Examiner*—Carroll B. Dority

[57] ABSTRACT

A clip for supporting miniature Christmas lights at any of a plurality of locations comprising a one-piece clip fabricated of a plastic material with limited resilience. A light supporting component is formed in a generally C-shaped configuration about a vertical axis of rotation. The supporting component is greater than 180 degrees and less than 190 degrees. A second component is formed integrally with the first component. The second component is adapted to be secured to a recipient surface to maintain the first component and the supportive bulb in a vertical orientation.

1 Claim, 4 Drawing Sheets

CLIPS FOR SUPPORTING MINIATURE CHRISTMAS LIGHTS AT ANY OF A PLURALITY OF LOCATIONS

BACKGROUND OF THE INVENTION

1. Field of the Invention

The present invention relates to clips for supporting miniature Christmas lights at any of a plurality of locations and more particularly pertains to supporting miniature Christmas lights on Christmas tree branches and other recipient surfaces.

2. Description of the Prior Art

The use of supporting devices for lamps, lights and other objects constructed of a wide variety of designs and configurations is known in the prior art. More specifically, supporting devices for lamps, lights and other objects constructed of a wide variety of designs and configurations heretofore devised and utilized for the purpose of supporting objects in preset positions through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. Des. 340,183 to Rumpel a Christmas light clip.

U.S. Pat. No. Des. 324,991 to Gary discloses a clip for mounting a decorative light bracket on a roof or similar planar support surface.

U.S. Pat. No. 3,596,859 to MacDonald discloses a light clip.

U.S. Pat. No. 3,749,346 to Cherniak discloses a saddle clip for hanging light fixtures.

Lastly, U.S. Pat. No. 5,103,380 to Lindner et al discloses a Christmas tree light apparatus.

In this respect, the clips for supporting miniature Christmas lights at any of a plurality of locations according to the present invention substantially departs from the conventional concepts and designs of the prior art, and in so doing provides an apparatus primarily developed for the purpose of supporting miniature Christmas lights on Christmas tree branches and other recipient surfaces.

Therefore, it can be appreciated that there exists a continuing need for new and improved clips for supporting miniature Christmas lights at any of a plurality of locations which can be used for supporting miniature Christmas lights on Christmas tree branches and other recipient surfaces. In this regard, the present invention substantially fulfills this need.

SUMMARY OF THE INVENTION

In view of the foregoing disadvantages inherent in the known types of supporting devices for lamps, lights and other objects constructed of a wide variety of designs and configurations now present in the prior art, the present invention provides improved clips for supporting miniature Christmas lights at any of a plurality of locations. As such, the general purpose of the present invention, which will be described subsequently in greater detail, is to provide a new and improved clips for supporting miniature Christmas lights at any of a plurality of locations apparatus and method which has all the advantages of the prior art and none of the disadvantages.

To attain this, the present invention essentially comprises a new and improved clip for supporting miniature Christmas lights at any of a plurality of locations comprising, in combination, a one-piece clip fabricated of a plastic material with limited resilience. A light supporting component is formed in a generally C-shaped configuration about a vertical axis of rotation. The supporting component is greater than 180 degrees and less than 190 degrees. A second component is formed integrally with the first component. The second component is adapted to be secured to a recipient surface to maintain the first component and the supportive bulb in a vertical orientation. The second component includes a clip with a first vertically disposed leg adjacent to the central exterior surface of the first component. The second component has a horizontal leg. The upper face of the horizontal leg is at an elevational orientation with the upper edge of the first member. The second leg also has a leg extending downwardly and inwardly than outwardly in a generally S-shaped configuration for being secured over a vertical recipient surface and a Christmas tree branch with the resilience of the legs adapted to provide a holding force to the device with respect to the recipient surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved clips for supporting miniature Christmas lights at any of a plurality of locations which have all the advantages of the prior art supporting devices for lamps, lights and other objects constructed of a wide variety of designs and configurations and none of the disadvantages.

It is another object of the present invention to provide new and improved clips for supporting miniature Christmas lights at any of a plurality of locations which may be easily and efficiently manufactured and marketed.

It is a further object of the present invention to provide new and improved clips for supporting miniature Christmas lights at any of a plurality of locations which are of a durable and reliable construction.

An even further object of the present invention is to provide new and improved clips for supporting miniature Christmas lights at any of a plurality of locations which are susceptible of a low cost of manufacture with regard to both materials and labor, and which accordingly are then susceptible of low prices of sale to the consuming public, thereby making such supporting devices for lamps, lights and other objects constructed of a wide variety of designs and configurations economically available to the buying public.

Still yet another object of the present invention is to provide new and improved clips for supporting miniature Christmas lights at any of a plurality of locations which provide in the apparatuses and methods of the prior art some of the advantages thereof, while simultaneously overcoming some of the disadvantages normally associated therewith.

Still another object of the present invention is to support miniature Christmas lights on Christmas tree branches and other recipient surfaces.

Lastly, it is an object of the present invention to provide new and improved clip for supporting miniature Christmas lights at any of a plurality of locations comprising a one-piece clip fabricated of a plastic material with limited resilience. A light supporting component is formed in a generally C-shaped configuration about a vertical axis of rotation. The supporting component is greater than 180 degrees and less than 190 degrees. A second component is formed integrally with the first component. The second component is adapted to be secured to a recipient surface to maintain the first component and the supportive bulb in a vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 3:
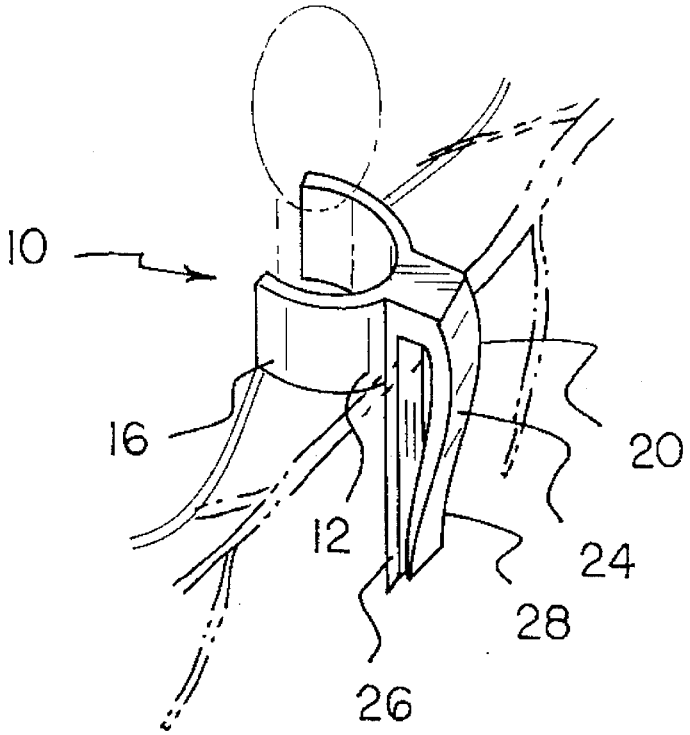
FIG. 3 is a perspective illustration of the preferred embodiment of the clips for supporting miniature Christmas lights at any of a plurality of locations constructed in accordance with the principles of the present invention.
Figure 4:
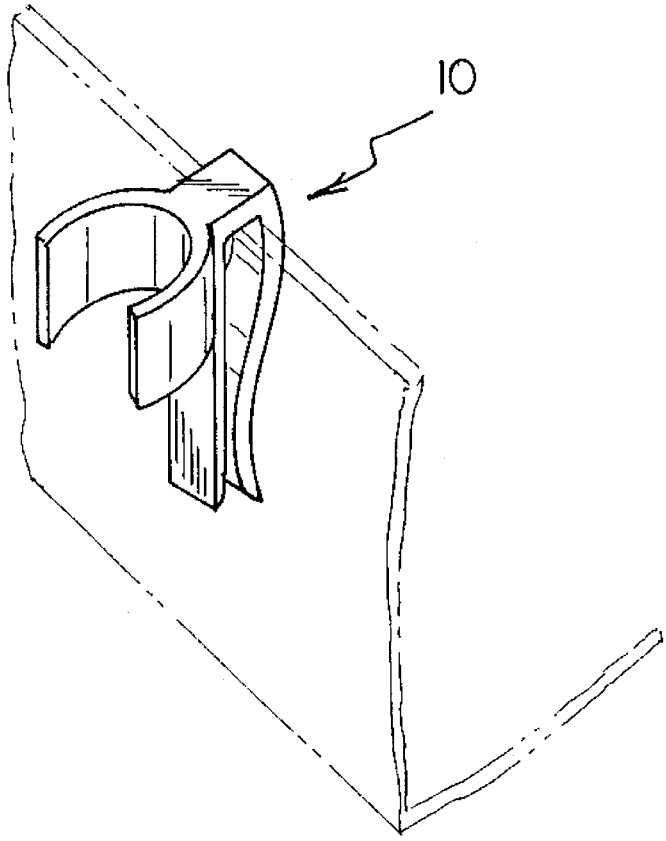
FIG. 4 is a perspective illustration of the device shown in FIG. 3 but shown from the other side and secured to a rain gutter rather than a Christmas tree branch.

With reference now to the drawings, and in particular to FIG. 3 thereof, new and improved clips for supporting miniature Christmas lights at any of a plurality of locations embodying the principles and concepts of the present invention and generally designated by the reference numeral 10 will be described.

The present invention, the new and improved clips for supporting miniature Christmas lights at any of a plurality of locations, is comprised of a plurality of components. Such components in their broadest context include a clip, light supporting component, and second component. Such components are individually configured and correlated with respect to each other so as to attain the desired objective.

The clips of the present invention are actually a system 10. The central component of such system is a one-piece clip 12. It is fabricated of a plastic material with a limited degree of resilience. Such is required to obtain the desired operating function.

The clip includes a lightbulb supporting component 16. Such component is formed in a generally C-shaped configuration about a vertical axis of rotation. The light supporting component takes the part of a circle in excess of a 180 degrees, preferably less than 190 degrees. Such is for receiving and supporting the base of a bulb therein.

The next component of the system 10 is a second component 20. Such second component is integrally formed with the first component. The second component is adapted to be secured to a recipient surface such as a Christmas tree or other tree or associated surface to which the light decorations are to be coupled. The function of the second component is to maintain the first component and the supported bulb in an appropriate orientation, normally vertical.

Figure 1:
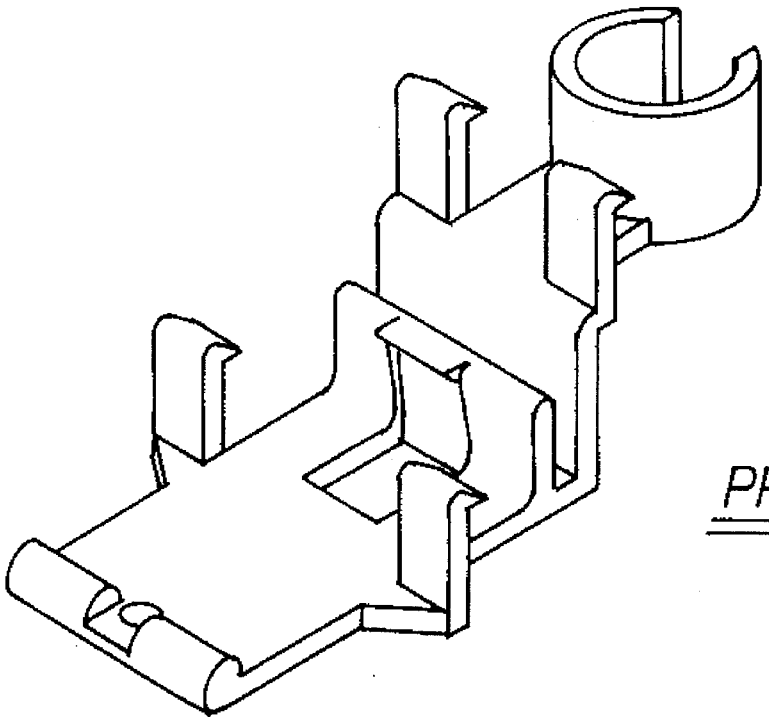
FIG 1 PRIOR ART
FIG. 1 is a perspective illustration of a prior art design for supporting Christmas lights.
Figure 2:
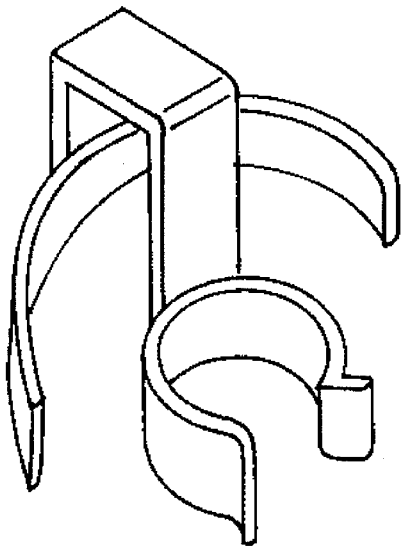
FIG 2 PRIOR ART
FIG. 2 is another prior art structure capable of supporting a Christmas tree light.

The second component also includes a clip 24. Such clip in the primary embodiment of FIGS. 1 and 2 has a first vertically disposed leg 26. Such leg is adjacent to the central exterior surface of the first component. The second component also has a horizontal leg 28. The upper surface of such horizontal leg is at an elevational orientation with the upper edge of the first member.

Figure 5:
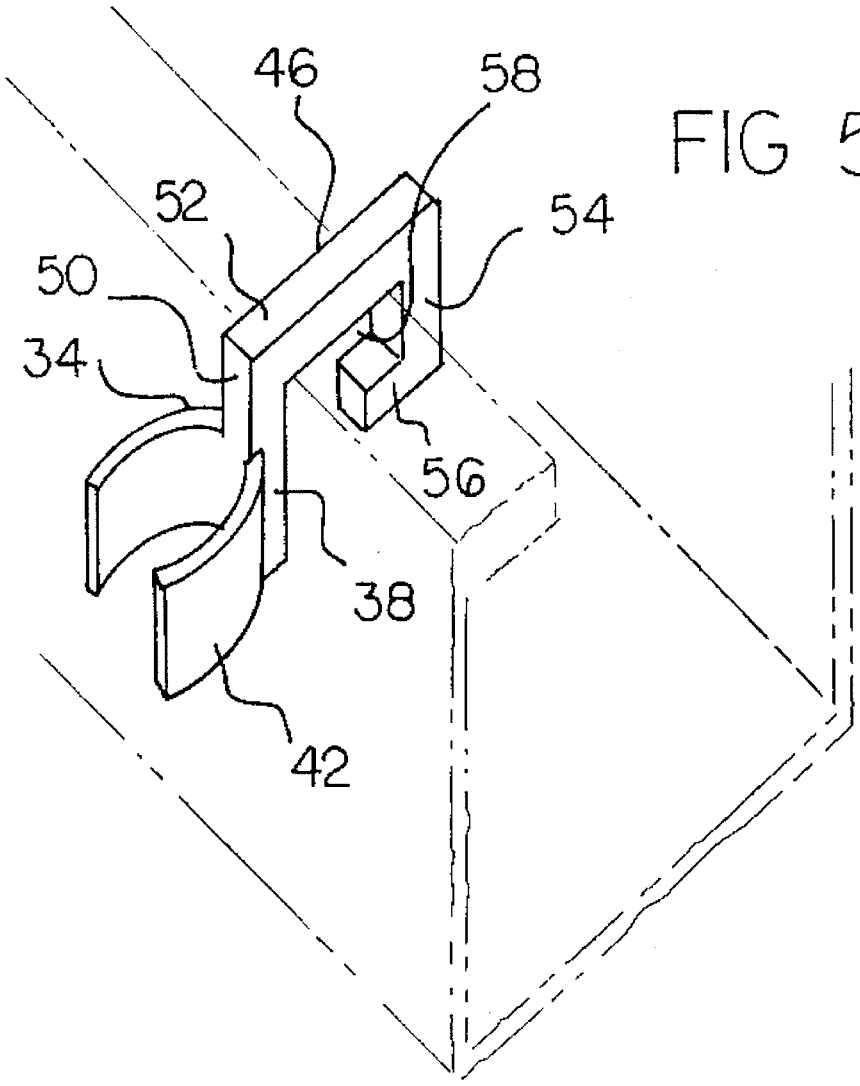
FIG. 5 is a perspective illustration of an alternate embodiment of the invention designed for coupling to a rain gutter with a lift.

An alternate embodiment of the invention is shown in FIG. 5. In such embodiment, clip 34 includes a modified second component having a first upwardly extending leg 38. Such leg is located adjacent to and coupled with respect to the central exterior surface of a first component. The first component is, as in the primary embodiment, in a generally C-shaped configuration with opposing arcuate legs 42. The legs are adapted to encompass a region greater than 180 degrees for supporting a bulb, not shown. The upper extent of the upwardly extending leg 38 has an upper region bent at 90 degrees to begin a horizontal leg 52 extending away from the first component with a central region 46 and terminating in a downwardly extending leg 54. Such downwardly extending leg extends downwardly to an extent to less than the height of the first light supporting component. It includes an inwardly directed short horizontal leg 56 thereadjacent. Thereabove is formed a recess 58. The recess is adapted to be received over the top of a ring-spout gutter lip with the lower short leg forming a parallel component adapted to be locked under the gutter lip. The gutter lip is shown in phantom lines.

Figure 6:
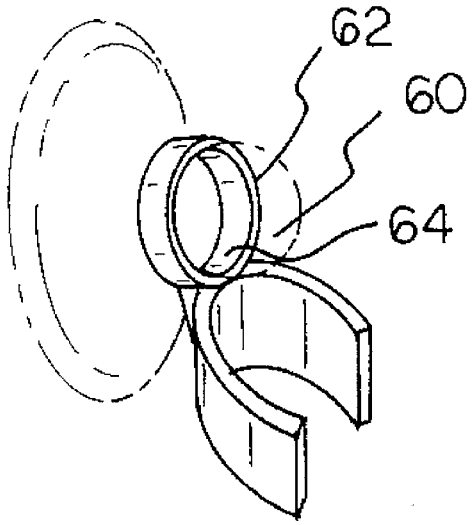
FIG. 6 is an other alternate embodiment of the invention designed for use with a suction cup for securement to a flat recipient surface.

A further alternate embodiment of the invention is shown in FIG. 6. In such embodiment, the device is adapted to be secured to a horizontally projecting component 60 of a suction cup. This is effected through a secondary component 62 formed integrally with the bulb supporting first component. The second component is adjacent to and preferably formed integral with the central exterior extent of the first component. The secondary component is formed in a circular configuration about a horizontal axis. The lower extent of the circular member is adjacent to and integral with the upper central extent of the first component.

Figure 7:
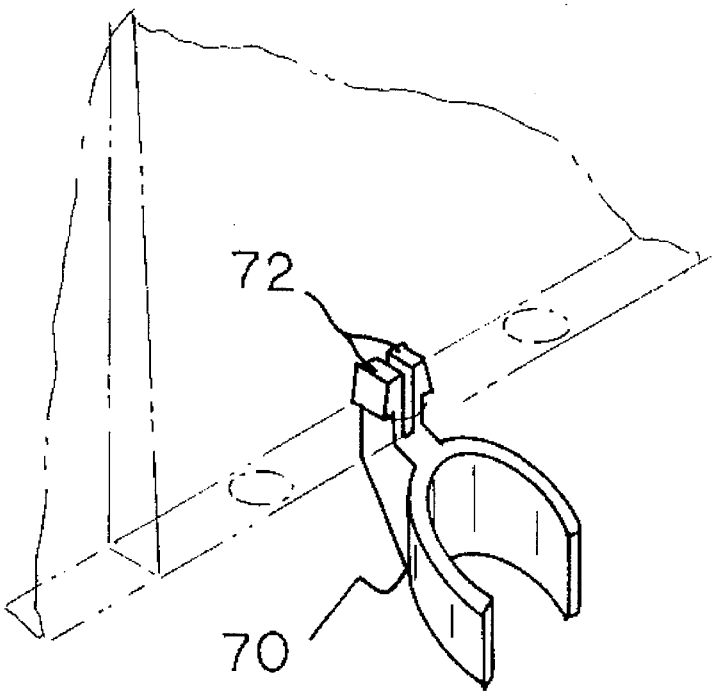
FIG. 7 is a perspective view of yet a further embodiment of the invention with a clip adapted to be inserted through and held by a horizontally disposed aperture.
Figure 8:
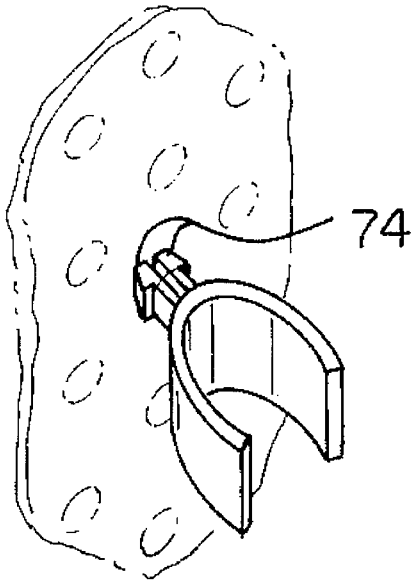
FIG. 8 is the final embodiment of the invention with a clip adapted to be positioned through and supported by an aperture in a vertical recipient surface.

The final two embodiments of the invention are shown in FIGS. 7 and 8. They are similar in that they are adapted to have their second component releasably coupled to a circular aperture. In the FIG. 7 embodiment, the second component 72 is fabricated as a bifurcated member with a horizontal recess located centrally therebetween. Barb-like projections extend laterally outwardly to a greater distance than the remaining area of the second component. The bifurcated members are adapted to be positioned through and beyond a horizontally disposed aperture in a recipient surface. The bifurcated members are adapted to be squeezed together by a user to allow the insertion of as well as the removal of the secondary component with respect to the recipient surface. Note is taken that the second component extends in a vertical orientation while the bulb-supporting, or first component 70, is in an essentially horizontal plane with a vertical axis.

The final embodiment of the invention is shown in FIG. 8. This is similar to the FIG. 7 embodiment in that the second component 74 is fabricated as a barb-like bifurcated member. It is formed with a horizontal recess centrally therebetween. Bifurcated projections extend laterally outwardly to a greater distance than the remaining areas of the second component. The bifurcated members are adapted to be positioned through and beyond a vertically disposed aperture in the recipient surface. The bifurcated members are adapted to be squeezed together by a user to allow the removal or insertion of the second component with respect to the recipient surface. In the second embodiment, the recess between the bifurcated members is horizontal, in a plane essentially co-extensive with that of the bulb supporting first component which has a vertical axis.

Small clips designed in a variety of styles which are used to securely attach miniature Christmas tree lights to various areas such as tree branches, window frames, or holiday decorative cut-outs.

Manufactured from a durable heavy-duty plastic, these clips are designed in numerous styles to accommodate a variety of uses. These small devices include a semi-circular clamp which fits around the base of the miniature light holder below the actual bulb. The remainder of the clip is designed differently for each one depending upon the item to which it is to be attached. For instance, a clip to be used within a tree branch includes two small clamps which holds the light securely onto the branch. Other styles feature small suction cups for windows or curved ends to fit along rain gutters. They also feature prongs which insert into pegboard or wooden cut-outs.

The clips are fitted around the base of the Christmas tree light. They do not need to be placed along every light, only where security and stability is necessary. The lights are then strung to the desired area clamping the lights to the tree, window, gutter, etc., along the way. Once positioned, these clips secure the miniature lights tightly in place and are not moved by the wind, rain, or snow.

These clips enable miniature Christmas tree lights to be secured anywhere along the home and are extremely durable for long lasting outside use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. New and improved clip for supporting miniature Christmas lights at any of a plurality of locations comprising in combination:

a one-piece clip fabricated of a plastic material with limited resilience;

a light supporting component formed in a generally C-shaped configuration about a vertical axis of rotation, the supporting component being greater than 180 degrees and less than 190 degrees the light supporting component having a central exterior surface, and an upper edge;

a second component formed integrally with the light supporting component, the second component adapted to be secured to a recipient surface to maintain the light supporting component and the miniature Christmas lights in a vertical orientation; and the second component including a clip with a first, straight and flat vertically disposed leg adjacent to the central exterior surface of the light supporting component, the second component having a straight horizontal leg with an upper face, the upper face is at an elevational orientation with the upper edge of the light supporting member such that the upper edge of the light supporting component and the upper face of the horizontal leg are planar with respect to one another, this configuration functioning to support a miniature Christmas light at an elevation above the second component, the second component also having a leg attached to an end of said horizontal leg opposite the light supporting component and extending downwardly and inwardly then outwardly in a generally smooth and curved configuration for being secured over a vertical recipient surface or a Christmas tree branch with the resilience of the legs adapted to provide a holding force to the branch or vertical recipient surface.

* * * * *